US009518572B2

(12) United States Patent
Barito et al.

(10) Patent No.: US 9,518,572 B2
(45) **Date of Patent: *Dec. 13, 2016**

(54) LINEAR COMPRESSOR

(71) Applicant: Haier US Appliance Solutions, Inc., Wilmington, DE (US)

(72) Inventors: Thomas R. Barito, Louisville, KY (US); Gregory William Hahn, Mount Washington, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 266 days.

This patent is subject to a terminal disclaimer.

(21) Appl. No.: 14/177,031

(22) Filed: Feb. 10, 2014

(65) Prior Publication Data

US 2015/0226199 A1 Aug. 13, 2015

(51) Int. Cl.
*F04B 35/04* (2006.01)

(52) U.S. Cl.
CPC ..... *F04B 35/04* (2013.01); *Y10T 29/49236* (2015.01)

(58) Field of Classification Search
CPC ... F04B 39/0005; F04B 39/122; F04B 35/045; Y10T 29/49236
See application file for complete search history.

(56) References Cited

U.S. PATENT DOCUMENTS 2,934,256 A * 4/1960 Lenning ..... F04B 35/045 417/274
3,606,594 A * 9/1971 Lewis et al. ..... F04B 39/127 417/415
3,810,719 A * 5/1974 Wolthers ..... F01L 25/08 417/317
4,002,935 A * 1/1977 Brauer ..... H02K 33/18 310/27
4,875,840 A * 10/1989 Johnson ..... F04C 29/023 184/6.18
5,040,372 A * 8/1991 Higham ..... F16F 7/116 310/15
5,145,345 A * 9/1992 Barito ..... F04C 27/005 277/399
5,146,124 A * 9/1992 Higham ..... F16F 7/116 310/17
5,439,360 A * 8/1995 Barito ..... F04C 29/0057 418/55.5
5,525,845 A * 6/1996 Beale ..... F02G 1/0435 310/12.27
5,597,294 A * 1/1997 McGrath ..... F04B 35/04 417/417
5,757,101 A * 5/1998 Boutaghou ..... H02K 1/2786 310/216.045

(Continued)

FOREIGN PATENT DOCUMENTS

BR WO 2013026115 A1 * 2/2013 ..... F04B 35/045
EP 0620367 4/1993

(Continued)

*Primary Examiner* — Charles Freay
(74) *Attorney, Agent, or Firm* — Dority & Manning, P.A.

(57) ABSTRACT

A linear compressor is provided. The linear compressor includes a casing and a machined spring. An inner back iron assembly is fixed to the machined spring at a middle portion of the machined spring. A driving coil is operable to move the inner back iron assembly in order to reciprocate a piston within a chamber of a cylinder assembly.

19 Claims, 12 Drawing Sheets

(56) References Cited

U.S. PATENT DOCUMENTS 5,944,302 A * 8/1999 Loc ..... F04B 35/045 267/180
5,993,178 A * 11/1999 Park ..... F04B 35/045 417/416
6,089,836 A * 7/2000 Seo ..... F04B 39/0005 417/415
6,210,120 B1 * 4/2001 Hugenroth ..... F04C 28/06 417/310
6,238,192 B1 * 5/2001 Lee ..... F04B 35/045 310/12.16
6,398,523 B1 * 6/2002 Hur ..... F04B 39/0055 417/312
6,491,506 B1 * 12/2002 Oh ..... F04B 35/045 417/406
6,547,538 B1 * 4/2003 Tamura ..... F04B 35/04 417/415
6,571,917 B1 * 6/2003 Hyun ..... F04B 39/0276 184/6.16
6,628,018 B2 * 9/2003 Song ..... H02K 33/16 310/12.24
6,652,252 B2 * 11/2003 Zabar ..... F04B 35/045 310/12.21
6,812,597 B2 * 11/2004 McGill ..... F04B 35/045 310/12.19
6,838,789 B2 * 1/2005 Kwon ..... H02K 33/16 310/12.01
6,942,470 B1 * 9/2005 Versini ..... A47J 31/4403 417/307
6,946,754 B2 * 9/2005 Inagaki ..... H02K 33/16 310/12.25
6,960,067 B2 * 11/2005 Jung ..... F04B 35/045 310/14
7,017,344 B2 * 3/2006 Pellizzari ..... F02G 1/0435 60/517
7,249,938 B2 * 7/2007 Noh ..... F04B 35/045 128/204.18
7,566,206 B2 * 7/2009 Lee ..... F04B 25/005 417/258
7,614,856 B2 * 11/2009 Inagaki ..... F04B 35/045 267/136
7,618,243 B2 * 11/2009 Tian ..... F04B 35/045 417/417
7,692,339 B2 * 4/2010 Berchowitz ..... F01B 11/007 310/12.01
7,726,020 B2 * 6/2010 Ebara ..... F04B 39/123 29/888.02
7,753,657 B2 * 7/2010 Strauss ..... F02D 41/20 123/497
7,921,845 B2 * 4/2011 Kim ..... F04B 35/045 128/204.18
7,988,430 B2 * 8/2011 Kang ..... F04B 35/045 417/416
8,011,183 B2 * 9/2011 Berchowitz ..... F02G 1/043 290/1 A
8,033,795 B2 * 10/2011 Dainez ..... F04B 35/045 318/687
8,113,797 B2 * 2/2012 Valbjoern ..... F04B 35/04 310/215
8,127,560 B2 * 3/2012 Dicken ..... F16F 1/125 60/520
8,157,604 B2 * 4/2012 Kotlyar ..... B63H 11/06 310/15
8,177,523 B2 * 5/2012 Patel ..... F04B 35/045 29/596
8,241,015 B2 * 8/2012 Lillie ..... F04B 35/045 417/363
8,550,789 B2 * 10/2013 Hu ..... F04B 17/04 318/119
8,894,380 B2 * 11/2014 Kang ..... F04B 17/04 417/417
8,926,296 B2 * 1/2015 Dainez ..... F04B 35/045 318/135
8,944,785 B2 * 2/2015 Lilie ..... F04B 35/045 417/417
8,998,589 B2 * 4/2015 Lilie ..... F04B 35/045 417/410.1
9,028,227 B2 * 5/2015 Sardet ..... H02K 33/16 417/416
2002/0057973 A1 * 5/2002 Choi ..... B41J 2/17596 417/413.3
2004/0115076 A1 * 6/2004 Lilie ..... F04B 35/045 417/416
2004/0191094 A1 * 9/2004 Kojima ..... F04B 35/04 417/415
2004/0245863 A1 * 12/2004 Hong ..... H02K 33/16 310/14
2004/0247457 A1 * 12/2004 Kim ..... F04B 35/045 417/312
2004/0247466 A1 * 12/2004 Lee ..... F04B 25/005 417/415
2005/0008512 A1 * 1/2005 McGill ..... F04B 35/045 417/416
2005/0060996 A1 * 3/2005 Pellizzari ..... F02G 1/0435 60/517
2005/0123422 A1 * 6/2005 Lilie ..... F04B 35/045 417/416
2005/0163635 A1 * 7/2005 Berwanger ..... F04B 35/045 417/415
2005/0214140 A1 * 9/2005 Lee ..... F04B 35/045 417/416
2006/0017332 A1 * 1/2006 Kang ..... F04B 35/045 310/15
2006/0018771 A1 * 1/2006 Song ..... F04B 35/045 417/416
2006/0024181 A1 * 2/2006 Kim ..... F04B 35/045 417/417
2006/0034712 A1 * 2/2006 Park ..... F04B 35/045 417/417
2006/0051220 A1 * 3/2006 Kwon ..... F04B 39/0276 417/416
2006/0108880 A1 * 5/2006 Lee ..... F04B 35/045 310/14
2006/0147326 A1 * 7/2006 Kakiuchi ..... F04B 39/0246 417/415
2006/0171822 A1 8/2006 Seagar et al.
2006/0250032 A1 * 11/2006 Her ..... F04B 35/045 310/13
2007/0159128 A1 * 7/2007 Dainez ..... F04B 35/045 318/687
2007/0286751 A1 * 12/2007 Manole ..... F04B 35/045 417/417
2007/0295201 A1 * 12/2007 Dadd ..... F04B 35/045 92/10
2008/0134833 A1 * 6/2008 Lilie ..... F04B 35/045 74/581
2008/0267798 A1 * 10/2008 Liu ..... F04B 35/045 417/416
2009/0039655 A1 2/2009 Berchowitz
2009/0094977 A1 * 4/2009 Hill ..... F02G 1/053 60/520
2009/0263262 A1 10/2009 McGill
2009/0280015 A1 * 11/2009 Lillie ..... F04B 35/045 417/416
2010/0183450 A1 * 7/2010 Schmidt ..... F04B 35/045 417/212
2010/0260627 A1 * 10/2010 Kang ..... F04B 35/045 417/417
2011/0008191 A1 * 1/2011 Lilie ..... F04B 35/045 417/410.1
2011/0056196 A1 3/2011 Berchowitz et al.
2011/0058960 A1 3/2011 Bernhard Lilie et al.
2011/0064593 A1 * 3/2011 Kang ..... F04B 35/045 417/410.1
2011/0070114 A1 * 3/2011 Milliff ..... F04C 18/0215 418/1
2011/0097224 A1 * 4/2011 Kang ..... F04B 35/045 417/417

(56) References Cited

U.S. PATENT DOCUMENTS

2011/0135518 A1* 6/2011 Kang ..... F04B 35/045 417/417
2011/0135523 A1* 6/2011 Williams ..... F04C 23/008 418/55.4
2011/0318193 A1* 12/2011 Hu ..... F04B 35/045 417/44.1
2012/0034114 A1* 2/2012 Lee ..... F04B 35/045 417/417
2012/0177513 A1* 7/2012 Lilie ..... F04B 35/045 417/417
2012/0251359 A1* 10/2012 Neelakantan ..... F04B 17/046 417/416
2013/0129540 A1* 5/2013 Song ..... F04B 35/045 417/415
2013/0195677 A1* 8/2013 Yoo ..... F04B 35/04 417/45
2014/0072461 A1* 3/2014 Barito ..... F04B 35/045 417/415
2014/0072462 A1* 3/2014 Filippa ..... F04B 35/045 417/415
2014/0105764 A1* 4/2014 Lee ..... F04B 35/04 417/363
2014/0193278 A1* 7/2014 Biesek ..... F04B 39/127 417/363
2014/0216064 A1* 8/2014 Champagne ..... F25B 9/14 62/6
2014/0234145 A1* 8/2014 Roman ..... F04B 35/045 417/481
2014/0241911 A1* 8/2014 Roman ..... F04B 35/045 417/328
2014/0301874 A1* 10/2014 Roettger ..... F04B 35/045 417/437
2015/0040752 A1* 2/2015 Roman ..... F04B 39/0022 92/172
2015/0226194 A1* 8/2015 Barito ..... F04B 39/0005 417/417
2015/0226197 A1* 8/2015 Hahn ..... F04B 35/045 417/363
2015/0226198 A1* 8/2015 Hahn ..... F04B 35/045 417/53
2015/0226199 A1* 8/2015 Barito ..... F04B 35/04 417/363
2015/0226200 A1* 8/2015 Beers ..... F04B 39/0005 417/416
2015/0226202 A1* 8/2015 Beers ..... F04B 39/0005 417/363
2015/0226203 A1* 8/2015 Hahn ..... F04B 35/045 417/415
2015/0226210 A1* 8/2015 Barito ..... F04B 35/045 417/415
2016/0017872 A1* 1/2016 Kim ..... F04B 35/045 417/415

FOREIGN PATENT DOCUMENTS

KR EP 1489720 A2 * 12/2004 ..... H02K 1/146
WO WO 2005/028841 3/2005
WO WO 2006/013377 2/2006
WO WO 2006/081642 2/2006
WO WO 2013/003923 1/2013

* cited by examiner

LINEAR COMPRESSOR

FIELD OF THE INVENTION

The present subject matter relates generally to linear compressors, e.g., for refrigerator appliances.

BACKGROUND OF THE INVENTION

Certain refrigerator appliances include sealed systems for cooling chilled chambers of the refrigerator appliance. The sealed systems generally include a compressor that generates compressed refrigerant during operation of the sealed system. The compressed refrigerant flows to an evaporator where heat exchange between the chilled chambers and the refrigerant cools the chilled chambers and food items located therein.

Recently, certain refrigerator appliances have included linear compressors for compressing refrigerant. Linear compressors generally include a piston and a driving coil. The driving coil receives a current that generates a force for sliding the piston forward and backward within a chamber. During motion of the piston within the chamber, the piston compresses refrigerant. However, friction between the piston and a wall of the chamber can negatively affect operation of the linear compressors if the piston is not suitably aligned within the chamber. In particular, friction losses due to rubbing of the piston against the wall of the chamber can negatively affect an efficiency of an associated refrigerator appliance.

The driving coil generally engages a magnet on a mover assembly of the linear compressor in order to reciprocate the piston within the chamber. The magnet is spaced apart from the driving coil by an air gap. In certain linear compressors, an additional air gap is provided at an opposite side of the magnet, e.g., between the magnet and an inner back iron of the linear compressor. However, multiple air gaps can negatively affect operation of the linear compressor by interrupting transmission of a magnetic field from the driving coil. In addition, maintaining a uniform air gap between the magnet and the driving coil and/or inner back iron can be difficult.

Accordingly, a linear compressor with features for limiting friction between a piston and a wall of a cylinder during operation of the linear compressor would be useful. In addition, a linear compressor with features for maintaining uniformity of an air gap between a magnet and a driving coil of the linear compressor would be useful. In particular, a linear compressor having only a single air gap would be useful.

BRIEF DESCRIPTION OF THE INVENTION

The present subject matter provides a linear compressor. The linear compressor includes a casing and a machined spring. An inner back iron assembly is fixed to the machined spring at a middle portion of the machined spring. A driving coil is operable to move the inner back iron assembly in order to reciprocate a piston within a chamber of a cylinder assembly. Additional aspects and advantages of the invention will be set forth in part in the following description, or may be apparent from the description, or may be learned through practice of the invention.

In a first exemplary embodiment, a linear compressor is provided. The linear compressor includes a driving coil. An inner back iron assembly is positioned in the driving coil. The inner back iron assembly extends between a first end portion and a second end portion. The inner back iron assembly includes an outer cylinder and a sleeve. The outer cylinder having an outer surface and an inner surface positioned opposite each other. The sleeve is mounted to the outer cylinder at the inner surface of the outer cylinder. A magnet is mounted to the inner back iron assembly at the outer surface of the inner back iron assembly such that the magnet faces the driving coil. The linear compressor also includes a machined spring. The machined spring includes a first cylindrical portion positioned adjacent the first end portion of the inner back iron assembly. A second cylindrical portion is positioned within and fixed to the inner back iron assembly. The sleeve extends between the inner surface of the outer cylinder and the second cylindrical portion in order to fix the sleeve to the outer cylinder. A first helical portion extends between and couples the first and second cylindrical portions together. A third cylindrical portion is positioned adjacent the second end portion of the inner back iron assembly. A second helical portion extends between and couples the second and third cylindrical portions together.

In a second exemplary embodiment, a linear compressor is provided. The linear compressor defines a radial direction, a circumferential direction and an axial direction. The linear compressor includes a machined spring. An inner back iron assembly extends about the machined spring along the circumferential direction. The inner back iron assembly includes an outer cylinder and a sleeve. The outer cylinder has an outer surface and an inner surface spaced apart from each other along the radial direction. The sleeve is positioned at the inner surface of the outer cylinder. The sleeve extends between the inner surface of the outer cylinder and a middle portion of the machined spring along the radial direction. A driving coil extends about the inner iron assembly along the circumferential direction. The driving coil is operable to move the inner back iron assembly along an axis during operation of the driving coil. A magnet is mounted to the inner back iron assembly such that the magnet is spaced apart from the driving coil by an air gap along the radial direction.

In a third exemplary embodiment, a method for making an inner back iron assembly for a linear compressor is provided. The method includes forming a plurality of laminations into a cylindrical shape, securing the laminations of the plurality of laminations together in order to form an outer cylinder of the inner back iron assembly, inserting a sleeve into the outer cylinder such that the sleeve is positioned on an inner surface of the outer cylinder, welding the sleeve to the outer cylinder, and attaching a middle portion of a machined spring to the sleeve.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
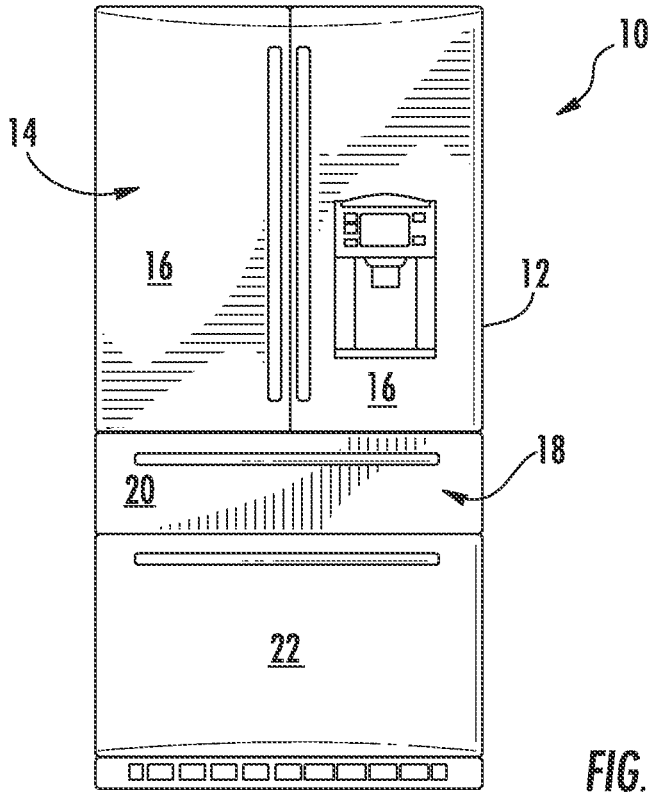
FIG. 1 is a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
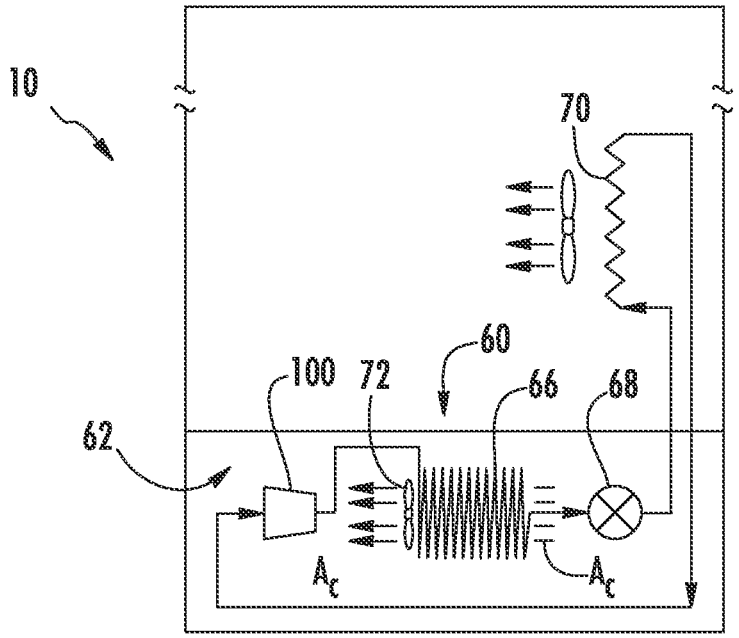
FIG. 2 is schematic view of certain components of the exemplary refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated exemplary embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Figure 3:
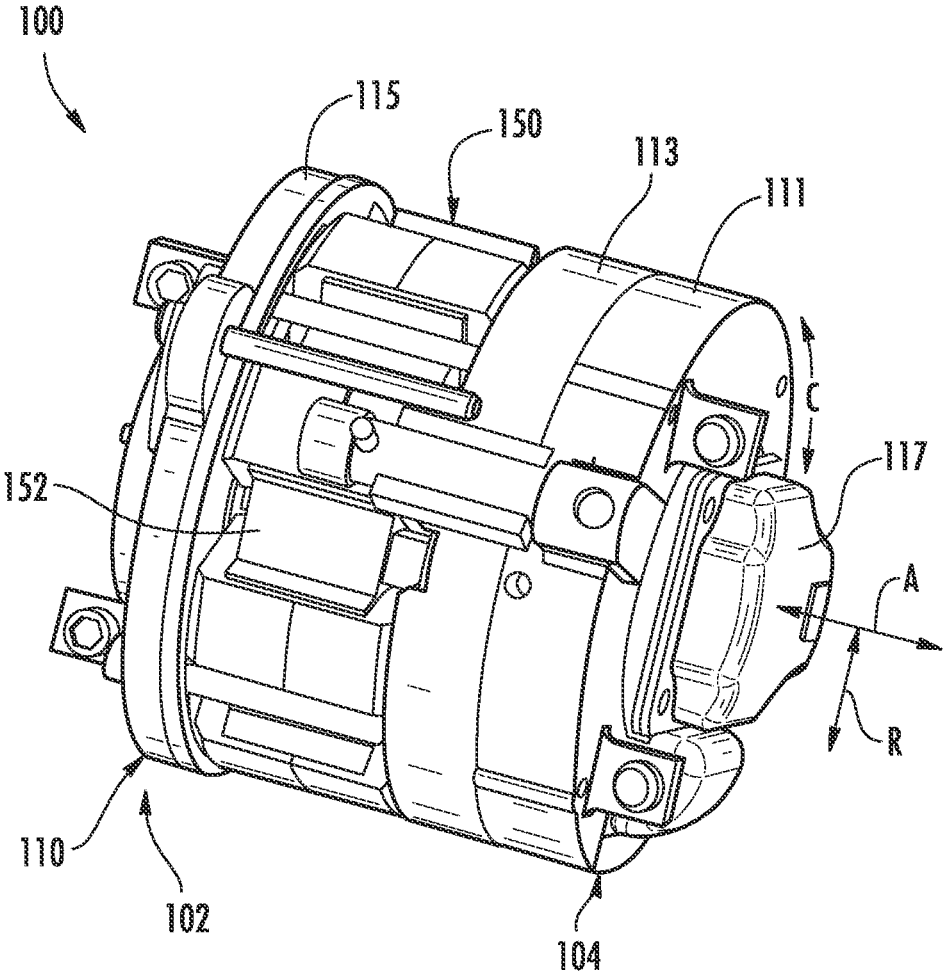
FIG. 3 provides a perspective view of a linear compressor according to an exemplary embodiment of the present subject matter.
Figure 4:
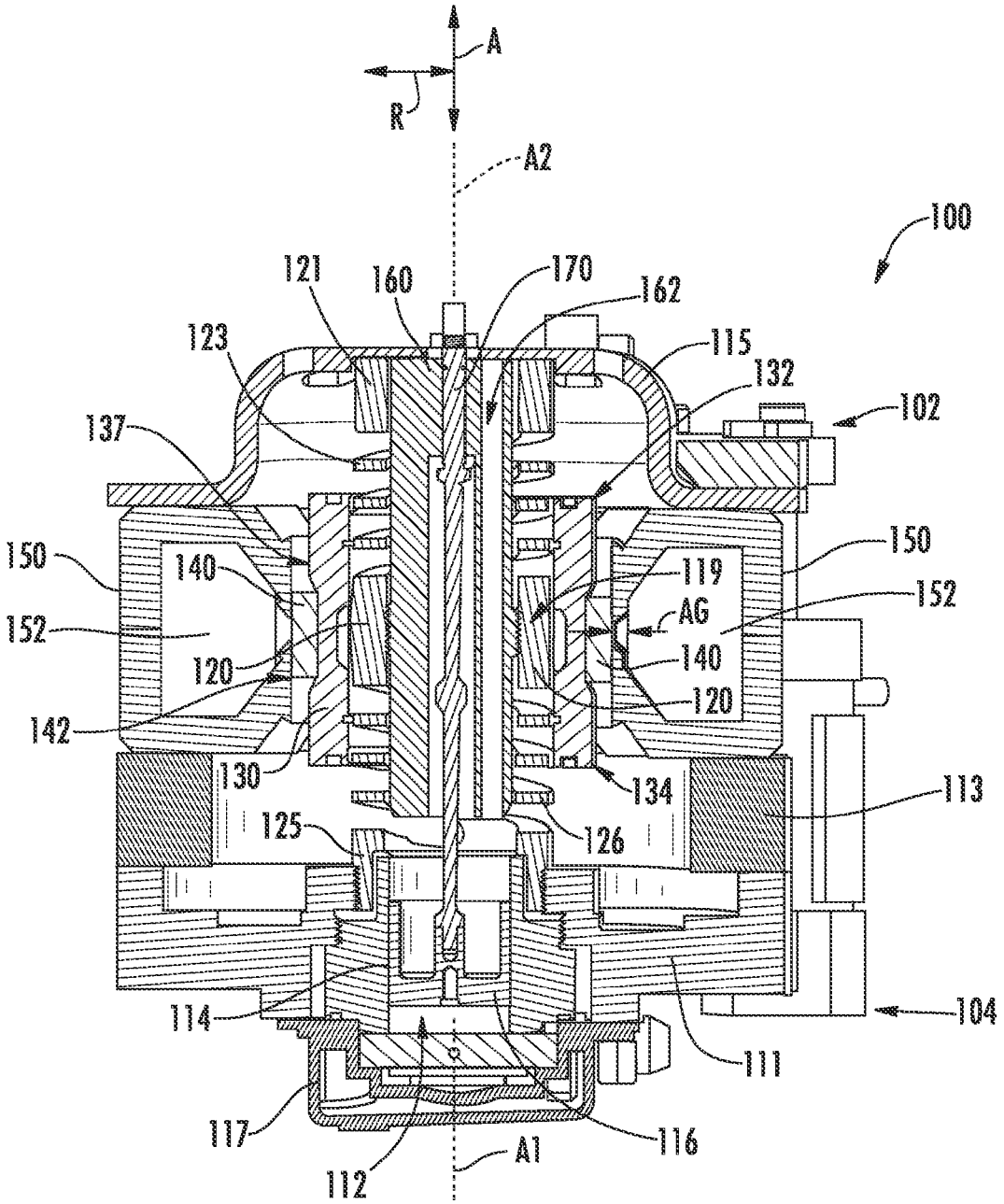
FIG. 4 provides a side section view of the exemplary linear compressor of FIG. 3.
Figure 5:
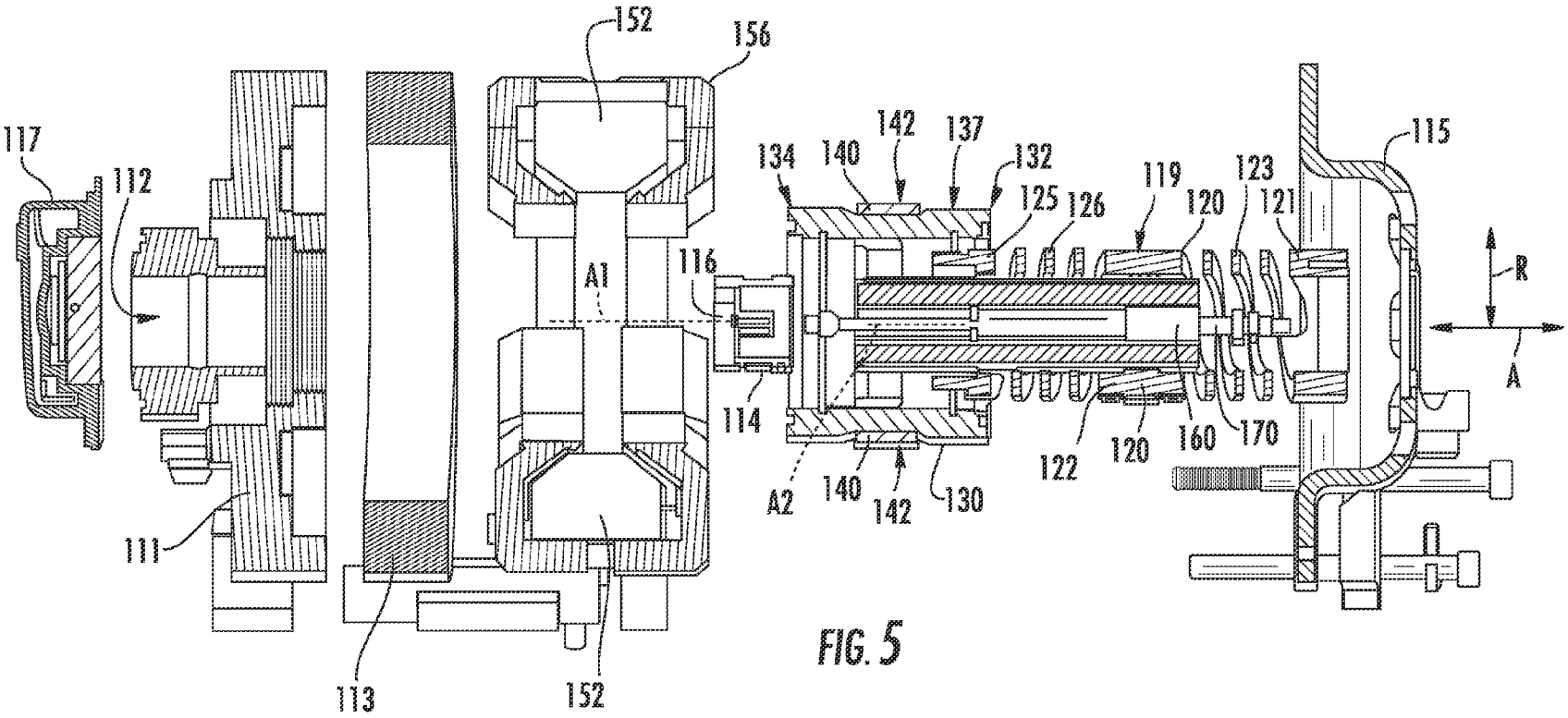
FIG. 5 provides an exploded view of the exemplary linear compressor of FIG. 4.

FIG. 3 provides a perspective view of a linear compressor 100 according to an exemplary embodiment of the present subject matter. FIG. 4 provides a side section view of linear compressor 100. FIG. 5 provides an exploded side section view of linear compressor 100. As discussed in greater detail below, linear compressor 100 is operable to increase a pressure of fluid within a chamber 112 of linear compressor 100. Linear compressor 100 may be used to compress any suitable fluid, such as refrigerant or air. In particular, linear compressor 100 may be used in a refrigerator appliance, such as refrigerator appliance 10 (FIG. 1) in which linear compressor 100 may be used as compressor 64 (FIG. 2). As may be seen in FIG. 3, linear compressor 100 defines an axial direction A, a radial direction R and a circumferential direction C. Linear compressor 100 may be enclosed within a hermetic or air-tight shell (not shown). The hermetic shell can, e.g., hinder or prevent refrigerant from leaking or escaping from refrigeration system 60.

Turning now to FIG. 4, linear compressor 100 includes a casing 110 that extends between a first end portion 102 and a second end portion 104, e.g., along the axial direction A. Casing 110 includes various static or non-moving structural components of linear compressor 100. In particular, casing 110 includes a cylinder assembly 111 that defines a chamber 112. Cylinder assembly 111 is positioned at or adjacent second end portion 104 of casing 110. Chamber 112 extends longitudinally along the axial direction A. Casing 110 also includes a motor mount mid-section 113 and an end cap 115 positioned opposite each other about a motor. A stator, e.g., including an outer back iron 150 and a driving coil 152, of the motor is mounted or secured to casing 110, e.g., such that the stator is sandwiched between motor mount mid-section 113 and end cap 115 of casing 110. Linear compressor 100 also includes valves (such as a discharge valve assembly 117 at an end of chamber 112) that permit refrigerant to enter and exit chamber 112 during operation of linear compressor 100.

A piston assembly 114 with a piston head 116 is slidably received within chamber 112 of cylinder assembly 111. In particular, piston assembly 114 is slidable along a first axis A1 within chamber 112. The first axis A1 may be substantially parallel to the axial direction A. During sliding of piston head 116 within chamber 112, piston head 116 compresses refrigerant within chamber 112. As an example, from a top dead center position, piston head 116 can slide within chamber 112 towards a bottom dead center position along the axial direction A, i.e., an expansion stroke of piston head 116. When piston head 116 reaches the bottom dead center position, piston head 116 changes directions and slides in chamber 112 back towards the top dead center position, i.e., a compression stroke of piston head 116. It should be understood that linear compressor 100 may include an additional piston head and/or additional chamber at an opposite end of linear compressor 100. Thus, linear compressor 100 may have multiple piston heads in alternative exemplary embodiments.

Linear compressor 100 also includes an inner back iron assembly 130. Inner back iron assembly 130 is positioned in the stator of the motor. In particular, outer back iron 150 and/or driving coil 152 may extend about inner back iron assembly 130, e.g., along the circumferential direction C Inner back iron assembly 130 extends between a first end portion 132 and a second end portion 134, e.g., along the axial direction A.

Inner back iron assembly 130 also has an outer surface 137. At least one driving magnet 140 is mounted to inner back iron assembly 130, e.g., at outer surface 137 of inner back iron assembly 130. Driving magnet 140 may face and/or be exposed to driving coil 152. In particular, driving magnet 140 may be spaced apart from driving coil 152, e.g., along the radial direction R by an air gap AG. Thus, the air gap AG may be defined between opposing surfaces of driving magnet 140 and driving coil 152. Driving magnet 140 may also be mounted or fixed to inner back iron assembly 130 such that an outer surface 142 of driving magnet 140 is substantially flush with outer surface 137 of inner back iron assembly 130. Thus, driving magnet 140 may be inset within inner back iron assembly 130. In such a manner, the magnetic field from driving coil 152 may have to pass through only a single air gap (e.g., air gap AG) between outer back iron 150 and inner back iron assembly 130 during operation of linear compressor 100, and linear compressor 100 may be more efficient than linear compressors with air gaps on both sides of a driving magnet.

As may be seen in FIG. 4, driving coil 152 extends about inner back iron assembly 130, e.g., along the circumferential direction C. Driving coil 152 is operable to move the inner back iron assembly 130 along a second axis A2 during operation of driving coil 152. The second axis may be substantially parallel to the axial direction A and/or the first axis A1. As an example, driving coil 152 may receive a current from a current source (not shown) in order to generate a magnetic field that engages driving magnet 140 and urges piston assembly 114 to move along the axial direction A in order to compress refrigerant within chamber 112 as described above and will be understood by those skilled in the art. In particular, the magnetic field of driving coil 152 may engage driving magnet 140 in order to move inner back iron assembly 130 along the second axis A2 and piston head 116 along the first axis A1 during operation of driving coil 152. Thus, driving coil 152 may slide piston assembly 114 between the top dead center position and the bottom dead center position, e.g., by moving inner back iron assembly 130 along the second axis A2, during operation of driving coil 152.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 152 of the motor. Thus, the controller may selectively activate driving coil 152, e.g., by supplying current to driving coil 152, in order to compress refrigerant with piston assembly 114 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Linear compressor 100 also includes a machined spring 120. Machined spring 120 is positioned in inner back iron assembly 130. In particular, inner back iron assembly 130 may extend about machined spring 120, e.g., along the circumferential direction C. Machined spring 120 also extends between first and second end portions 102 and 104 of casing 110, e.g., along the axial direction A. Machined spring 120 assists with coupling inner back iron assembly 130 to casing 110, e.g., cylinder assembly 111 of casing 110. In particular, inner back iron assembly 130 is fixed to machined spring 120 at a middle portion 119 of machined spring 120 as discussed in greater detail below.

During operation of driving coil 152, machined spring 120 supports inner back iron assembly 130. In particular, inner back iron assembly 130 is suspended by machined spring 120 within the stator of the motor such that motion of inner back iron assembly 130 along the radial direction R is hindered or limited while motion along the second axis A2 is relatively unimpeded. Thus, machined spring 120 may be substantially stiffer along the radial direction R than along the axial direction A. In such a manner, machined spring 120 can assist with maintaining a uniformity of the air gap AG between driving magnet 140 and driving coil 152, e.g., along the radial direction R, during operation of the motor and movement of inner back iron assembly 130 on the second axis A2. Machined spring 120 can also assist with hindering side pull forces of the motor from transmitting to piston assembly 114 and being reacted in cylinder assembly 111 as a friction loss.

Figure 6:
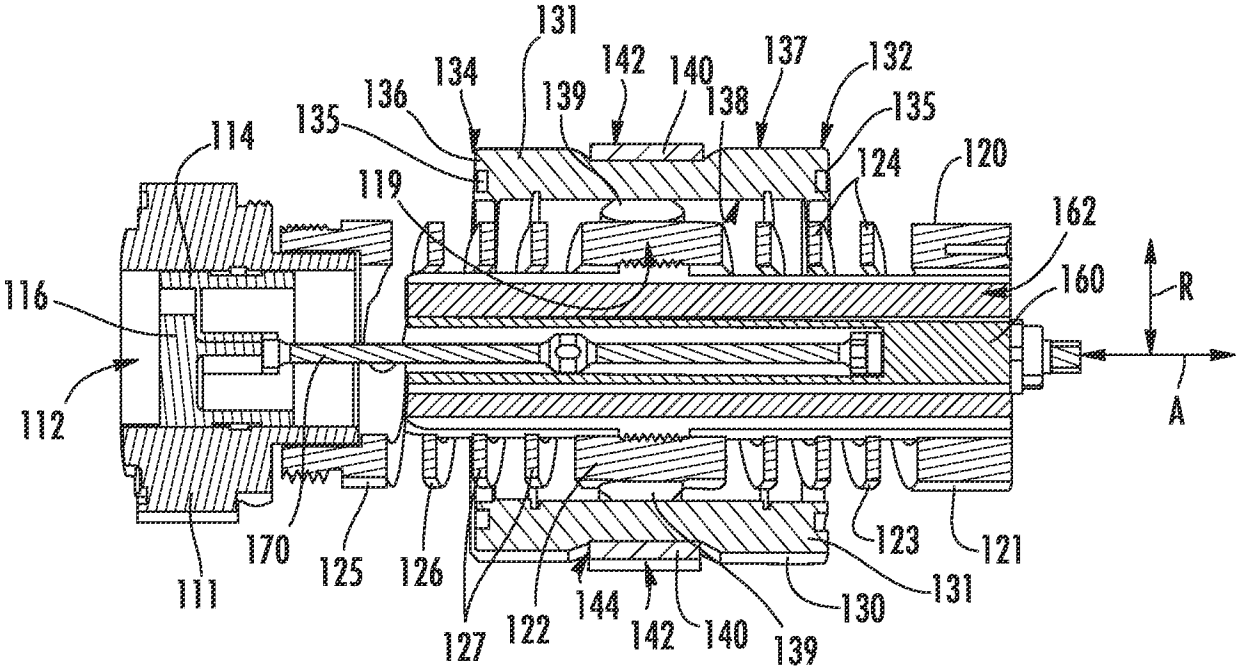
FIG. 6 provides a side section view of certain components of the exemplary linear compressor of FIG. 3.
Figure 7:
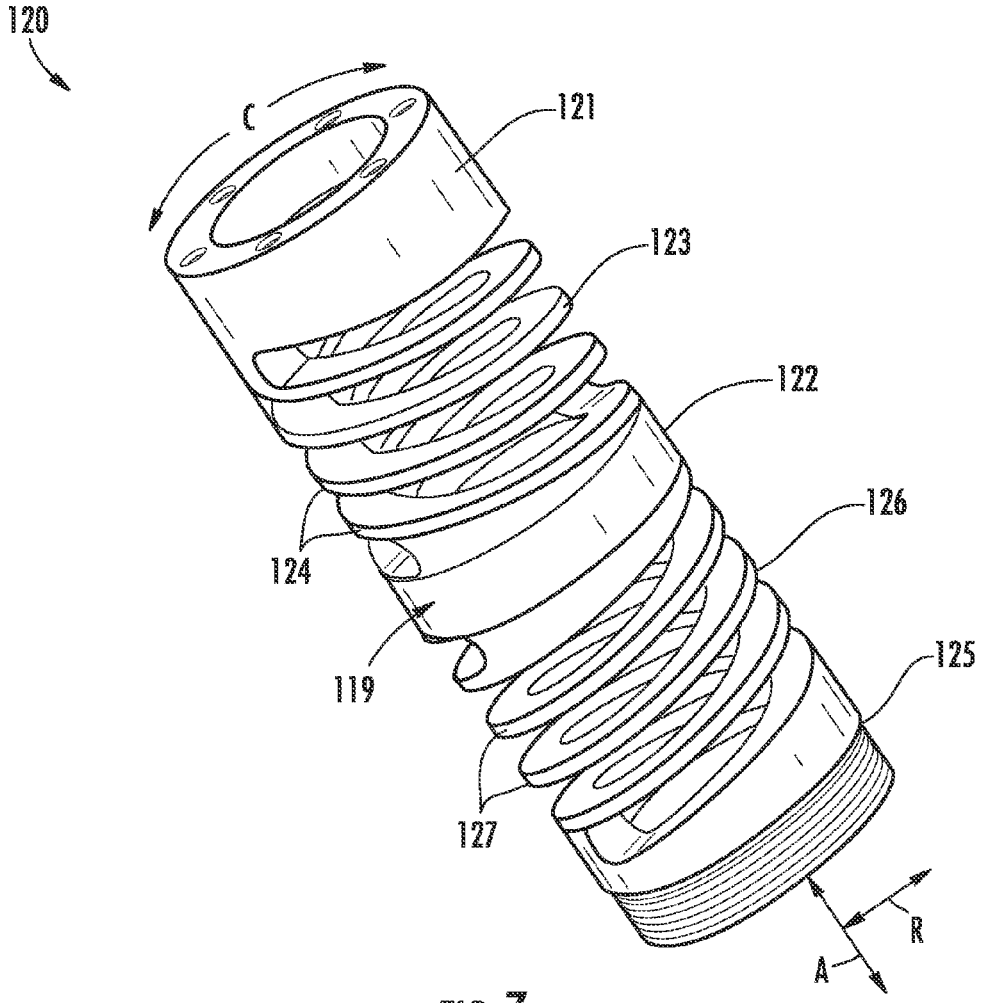
FIG. 7 provides a perspective view of a machined spring of the exemplary linear compressor of FIG. 3.

FIG. 6 provides a side section view of certain components of linear compressor 100. FIG. 7 provides a perspective view of machined spring 120. As may be seen in FIG. 7, machined spring 120 includes a first cylindrical portion 121, a second cylindrical portion 122, a first helical portion 123, a third cylindrical portion 125 and a second helical portion 126. First helical portion 123 of machined spring 120 extends between and couples first and second cylindrical portions 121 and 122 of machined spring 120, e.g., along the axial direction A. Similarly, second helical portion 126 of machined spring 120 extends between and couples second and third cylindrical portions 122 and 125 of machined spring 120, e.g., along the axial direction A.

Turning back to FIG. 4, first cylindrical portion 121 is mounted or fixed to casing 110 at first end portion 102 of casing 110. Thus, first cylindrical portion 121 is positioned at or adjacent first end portion 102 of casing 110. Third cylindrical portion 125 is mounted or fixed to casing 110 at second end portion 104 of casing 110, e.g., to cylinder assembly 111 of casing 110. Thus, third cylindrical portion 125 is positioned at or adjacent second end portion 104 of casing 110. Second cylindrical portion 122 is positioned at middle portion 119 of machined spring 120. In particular, second cylindrical portion 122 is positioned within and fixed to inner back iron assembly 130. Second cylindrical portion 122 may also be positioned equidistant from first and third cylindrical portions 121 and 125, e.g., along the axial direction A.

First cylindrical portion 121 of machined spring 120 is mounted to casing 110 with fasteners (not shown) that extend though end cap 115 of casing 110 into first cylindrical portion 121. In alternative exemplary embodiments, first cylindrical portion 121 of machined spring 120 may be threaded, welded, glued, fastened, or connected via any other suitable mechanism or method to casing 110. Third cylindrical portion 125 of machined spring 120 is mounted to cylinder assembly 111 at second end portion 104 of casing 110 via a screw thread of third cylindrical portion 125 threaded into cylinder assembly 111. In alternative exemplary embodiments, third cylindrical portion 125 of machined spring 120 may be welded, glued, fastened, or connected via any other suitable mechanism or method, such as an interference fit, to casing 110.

As may be seen in FIG. 7, first helical portion 123 extends, e.g., along the axial direction A, between first and second cylindrical portions 121 and 122 and couples first and second cylindrical portions 121 and 122 together. Similarly, second helical portion 126 extends, e.g., along the axial direction A, between second and third cylindrical portions 122 and 125 and couples second and third cylindrical portions 122 and 125 together. Thus, second cylindrical portion 122 is suspended between first and third cylindrical portions 121 and 125 with first and second helical portions 123 and 126.

First and second helical portions 123 and 126 and first, second and third cylindrical portions 121, 122 and 125 of machined spring 120 may be continuous with one another and/or integrally mounted to one another. As an example, machined spring 120 may be formed from a single, continuous piece of metal, such as steel, or other elastic material. In addition, first, second and third cylindrical portions 121, 122 and 125 and first and second helical portions 123 and 126 of machined spring 120 may be positioned coaxially relative to one another, e.g., on the second axis A2.

First helical portion 123 includes a first pair of helices 124. Thus, first helical portion 123 may be a double start helical spring. Helical coils of first helices 124 are separate from each other. Each helical coil of first helices 124 also extends between first and second cylindrical portions 121 and 122 of machined spring 120. Thus, first helices 124 couple first and second cylindrical portions 121 and 122 of machined spring 120 together. In particular, first helical portion 123 may be formed into a double-helix structure in which each helical coil of first helices 124 is wound in the same direction and connect first and second cylindrical portions 121 and 122 of machined spring 120.

Second helical portion 126 includes a second pair of helices 127. Thus, second helical portion 126 may be a double start helical spring. Helical coils of second helices 127 are separate from each other. Each helical coil of second helices 127 also extends between second and third cylindrical portions 122 and 125 of machined spring 120. Thus, second helices 127 couple second and third cylindrical portions 122 and 125 of machined spring 120 together. In particular, second helical portion 126 may be formed into a double-helix structure in which each helical coil of second helices 127 is wound in the same direction and connect second and third cylindrical portions 122 and 125 of machined spring 120.

By providing first and second helices 124 and 127 rather than a single helix, a force applied by machined spring 120 may be more even and/or inner back iron assembly 130 may rotate less during motion of inner back iron assembly 130 along the second axis A2. In addition, first and second helices 124 and 127 may be counter or oppositely wound. Such opposite winding may assist with further balancing the force applied by machined spring 120 and/or inner back iron assembly 130 may rotate less during motion of inner back iron assembly 130 along the second axis A2. In alternative exemplary embodiments, first and second helices 124 and 127 may include more than two helices. For example, first and second helices 124 and 127 may each include three helices, four helices, five helices or more.

By providing machined spring 120 rather than a coiled wire spring, performance of linear compressor 100 can be improved. For example, machined spring 120 may be more reliable than comparable coiled wire springs. In addition, the stiffness of machined spring 120 along the radial direction R may be greater than that of comparable coiled wire springs. Further, comparable coiled wire springs include an inherent unbalanced moment. Machined spring 120 may be formed to eliminate or substantially reduce any inherent unbalanced moments. As another example, adjacent coils of a comparable coiled wire spring contact each other at an end of the coiled wire spring, and such contact may dampen motion of the coiled wire spring thereby negatively affecting a performance of an associated linear compressor. In contrast, by being formed of a single continuous material and having no contact between adjacent coils, machined spring 120 may have less dampening than comparable coiled wire springs.

As may be seen in FIG. 6, inner back iron assembly 130 includes an outer cylinder 136 and a sleeve 139. Outer cylinder 136 defines outer surface 137 of inner back iron assembly 130 and also has an inner surface 138 positioned opposite outer surface 137 of outer cylinder 136. Sleeve 139 is positioned on or at inner surface 138 of outer cylinder 136. A first interference fit between outer cylinder 136 and sleeve 139 may couple or secure outer cylinder 136 and sleeve 139 together. In alternative exemplary embodiments, sleeve 139 may be welded, glued, fastened, or connected via any other suitable mechanism or method to outer cylinder 136. Sleeve 139 may be constructed of or with any suitable material. For example, sleeve 139 may be a cylindrical piece of metal, such as steel, in certain exemplary embodiments.

Sleeve 139 extends about machined spring 120, e.g., along the circumferential direction C. In addition, middle portion 119 of machined spring 120 (e.g., third cylindrical portion 125) is mounted or fixed to inner back iron assembly 130 with sleeve 139. As may be seen in FIG. 6, sleeve 139 extends between inner surface 138 of outer cylinder 136 and middle portion 119 of machined spring 120, e.g., along the radial direction R. In particular, sleeve 139 extends between inner surface 138 of outer cylinder 136 and second cylindrical portion 122 of machined spring 120, e.g., along the radial direction R. A second interference fit between sleeve 139 and middle portion 119 of machined spring 120 may couple or secure sleeve 139 and middle portion 119 of machined spring 120 together. In alternative exemplary embodiments, sleeve 139 may be welded, glued, fastened, or connected via any other suitable mechanism or method to middle portion 119 of machined spring 120 (e.g., second cylindrical portion 122 of machined spring 120).

Outer cylinder 136 may be constructed of or with any suitable material. For example, outer cylinder 136 may be constructed of or with a plurality of (e.g., ferromagnetic) laminations 131. Laminations 131 are distributed along the circumferential direction C in order to form outer cylinder 136. Laminations 131 are mounted to one another or secured together, e.g., with rings 135 at first and second end portions 132 and 134 of inner back iron assembly 130. Outer cylinder 136, e.g., laminations 131, define a recess 144 that extends inwardly from outer surface 137 of outer cylinder 136, e.g., along the radial direction R. Driving magnet 140 is positioned in recess 144, e.g., such that driving magnet 140 is inset within outer cylinder 136.

A piston flex mount 160 is mounted to and extends through inner back iron assembly 130. In particular, piston flex mount 160 is mounted to inner back iron assembly 130 via sleeve 139 and machined spring 120. Thus, piston flex mount 160 may be coupled (e.g., threaded) to machined spring 120 at second cylindrical portion 122 of machined spring 120 in order to mount or fix piston flex mount 160 to inner back iron assembly 130. A flexible or compliant coupling 170 extends between piston flex mount 160 and piston assembly 114, e.g., along the axial direction A. Thus, compliant coupling 170 connects inner back iron assembly 130 and piston assembly 114 such that motion of inner back iron assembly 130, e.g., along the axial direction A or the second axis A2, is transferred to piston assembly 114.

Figure 10:
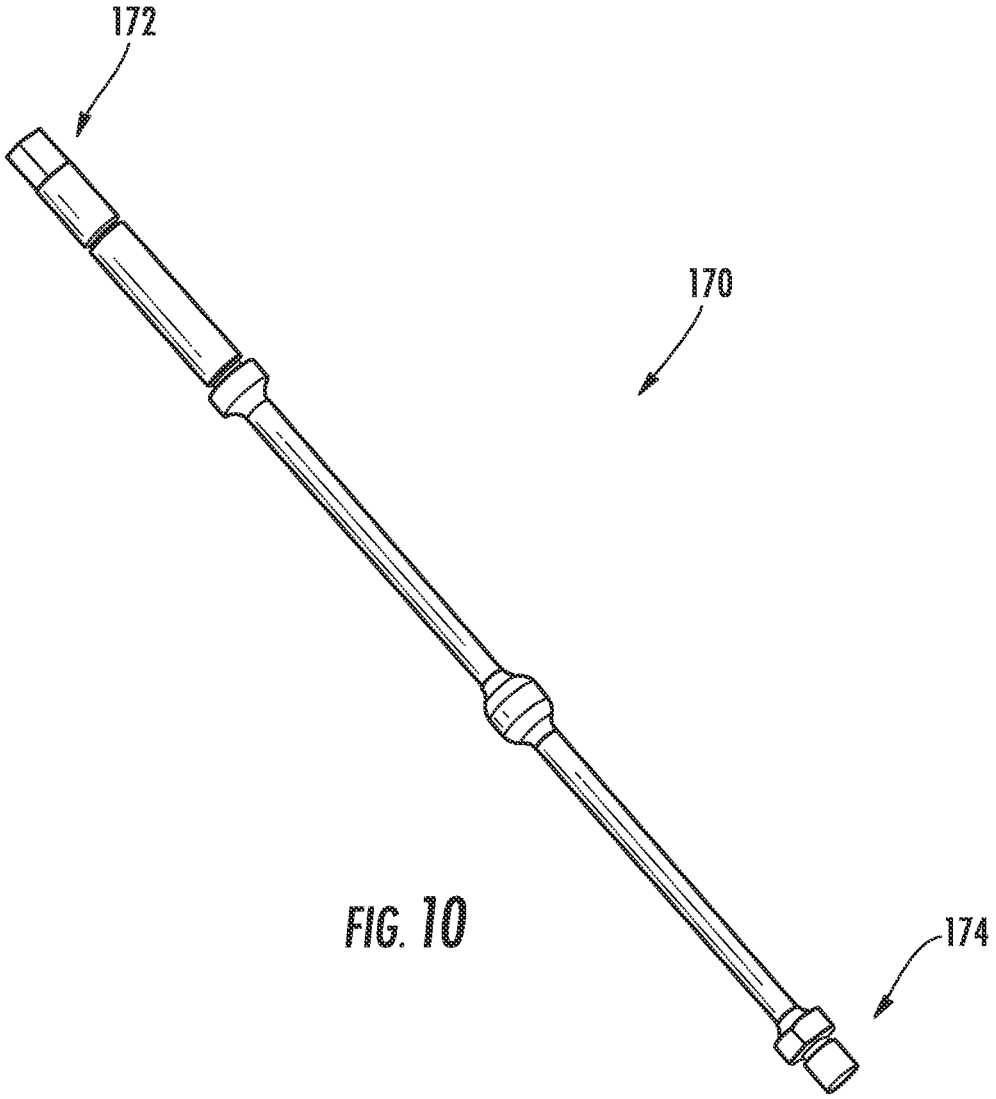
FIG. 10 provides a perspective view of a compliant coupling of the exemplary linear compressor of FIG. 3.

FIG. 10 provides a perspective view of compliant coupling 170. As may be seen in FIG. 10, compliant coupling 170 extends between a first end portion 172 and a second end portion 174, e.g., along the axial direction A. Turning back to FIG. 6, first end portion 172 of compliant coupling 170 is mounted to the piston flex mount 160, and second end portion 174 of compliant coupling 170 is mounted to piston assembly 114. First and second end portions 172 and 174 of compliant coupling 170 may be positioned at opposite sides of driving coil 152. In particular, compliant coupling 170 may extend through driving coil 152, e.g., along the axial direction A.

As discussed above, compliant coupling 170 may extend between inner back iron assembly 130 and piston assembly 114, e.g., along the axial direction A, and connect inner back iron assembly 130 and piston assembly 114 together. In particular, compliant coupling 170 transfers motion of inner back iron assembly 130 along the axial direction A to piston assembly 114. However, compliant coupling 170 is compliant or flexible along the radial direction R. In particular, compliant coupling 170 may be sufficiently compliant along the radial direction R such little or no motion of inner back iron assembly 130 along the radial direction R is transferred to piston assembly 114 by compliant coupling 170. In such a manner, side pull forces of the motor are decoupled from piston assembly 114 and/or cylinder assembly 111 and friction between position assembly 114 and cylinder assembly 111 may be reduced.

Figure 8:
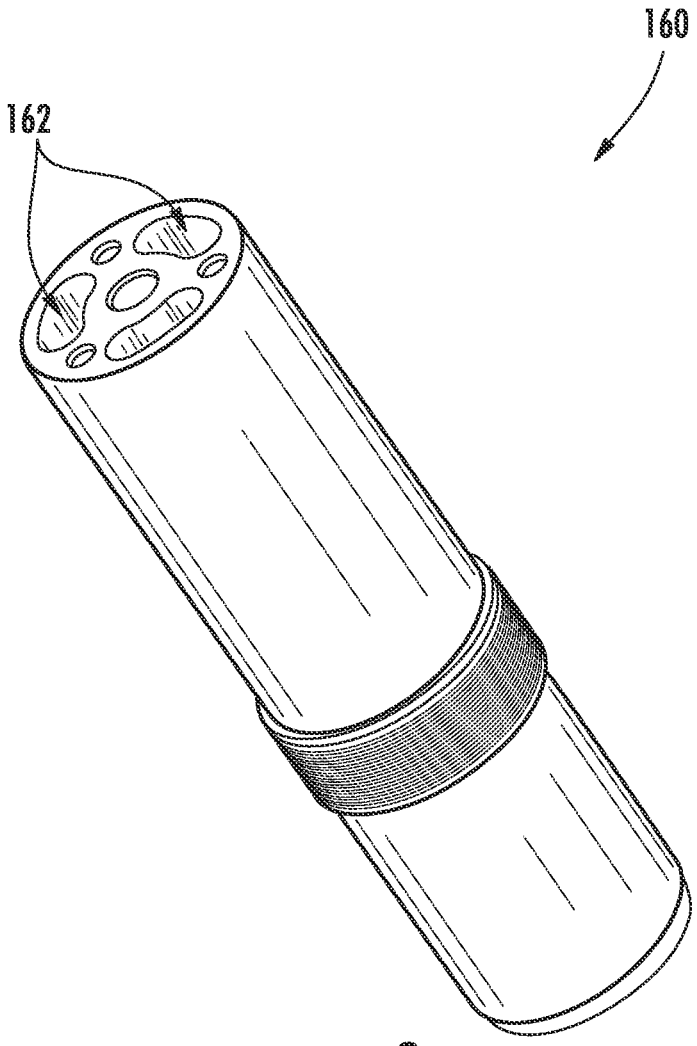
FIG. 8 provides a perspective view of a piston flex mount of the exemplary linear compressor of FIG. 3.
Figure 9:
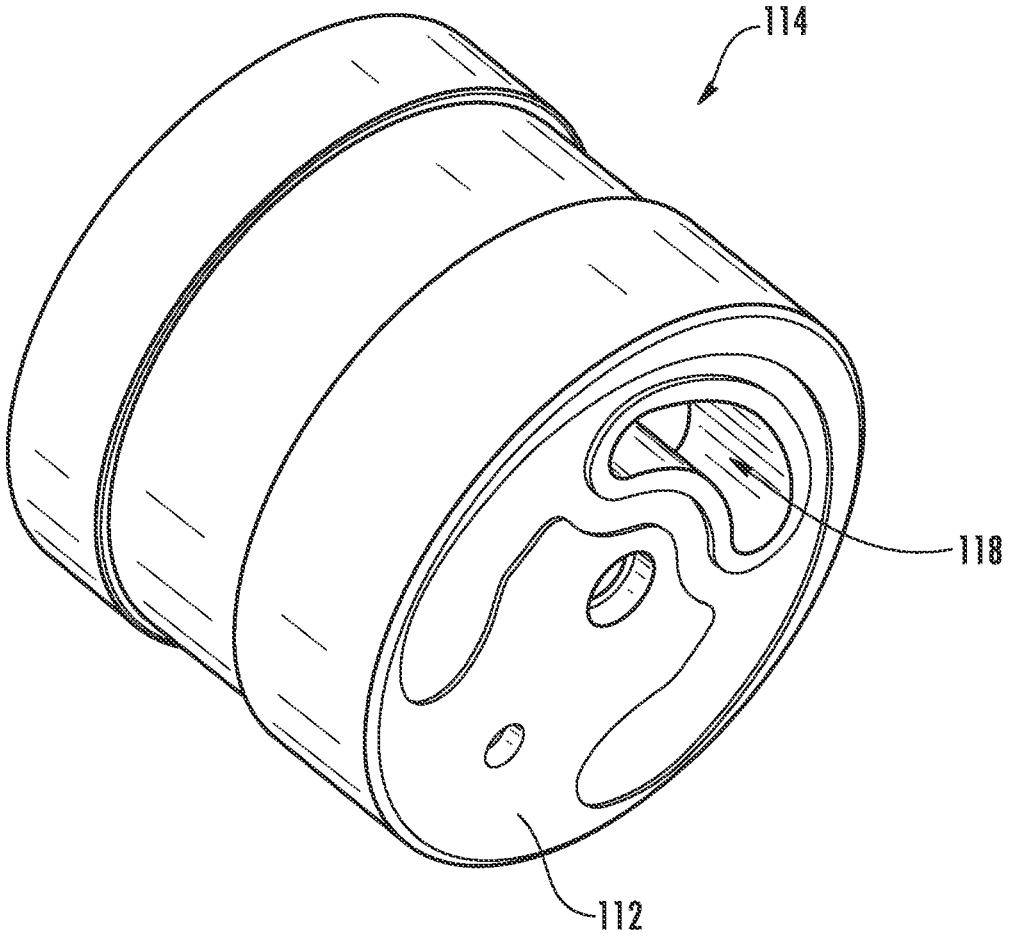
FIG. 9 provides a perspective view of a piston of the exemplary linear compressor of FIG. 3.

FIG. 8 provides a perspective view of piston flex mount 160. FIG. 9 provides a perspective view of piston assembly 114. As may be seen in FIG. 8, piston flex mount 160 defines at least one passage 162. Passage 162 of piston flex mount 160 extends, e.g., along the axial direction A, through piston flex mount 160. Thus, a flow of fluid, such as air or refrigerant, may pass though piston flex mount 160 via passage 162 of piston flex mount 160 during operation of linear compressor 100.

As may be seen in FIG. 9, piston head 116 also defines at least one opening 118. Opening 110 of piston head 116 extends, e.g., along the axial direction A, through piston head 116. Thus, the flow of fluid may pass though piston head 116 via opening 118 of piston head 116 into chamber 112 during operation of linear compressor 100. In such a manner, the flow of fluid (that is compressed by piston head 114 within chamber 112) may flow through piston flex mount 160 and inner back iron assembly 130 to piston assembly 114 during operation of linear compressor 100.

Figure 11:
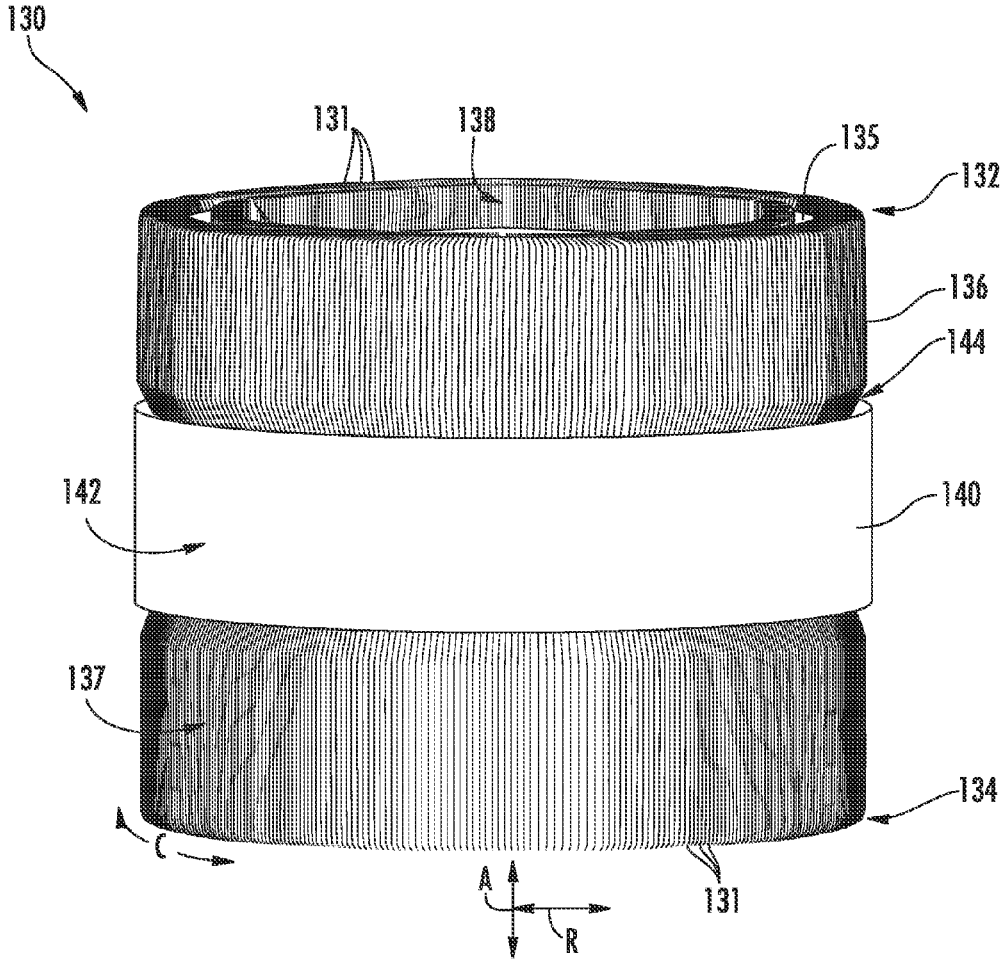
FIG. 11 provides a perspective view of an inner back iron assembly of the exemplary linear compressor of FIG. 3.
Figure 12:
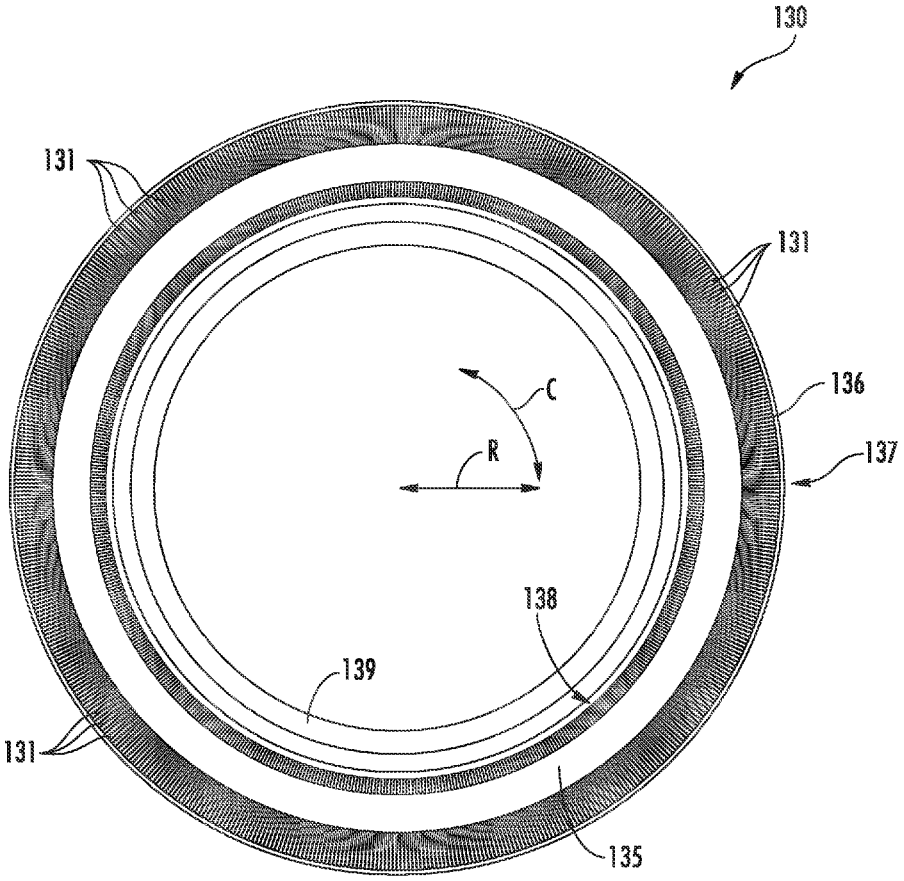
FIG. 12 provides a top, plan view of the inner back iron assembly of FIG. 11.

FIG. 11 provides a perspective view of inner back iron assembly 130. FIG. 12 provides a top, plan view of inner back iron assembly 130. As may be seen in FIGS. 11 and 12, driving magnet 142 is positioned at or on outer surface 137 of inner back iron assembly 130. Outer cylinder 136 of inner back iron assembly 130 may be constructed or configured for providing (e.g., a low reluctance) path for magnetic flux.

Outer cylinder 136 may be constructed of or with any suitable material. For example, outer cylinder 136 may be constructed of or with a plurality of (e.g., ferromagnetic) laminations 131. Laminations 131 are distributed along the circumferential direction C in order to form outer cylinder 136. Laminations 131 are mounted to one another or secured together, e.g., with rings 135 at first and second end portions 132 and 134 of inner back iron assembly 130. Rings 135 may be press-fit into outer cylinder 136 at first and second end portions 132 and 134 of inner back iron assembly 130. Outer cylinder 136, e.g., laminations 131, define a recess 144 that extends inwardly from outer surface 137 of outer cylinder 136, e.g., along the radial direction R. Driving magnet 140 is positioned in recess 144, e.g., such that driving magnet 140 is inset within outer cylinder 136.

Figure 13:
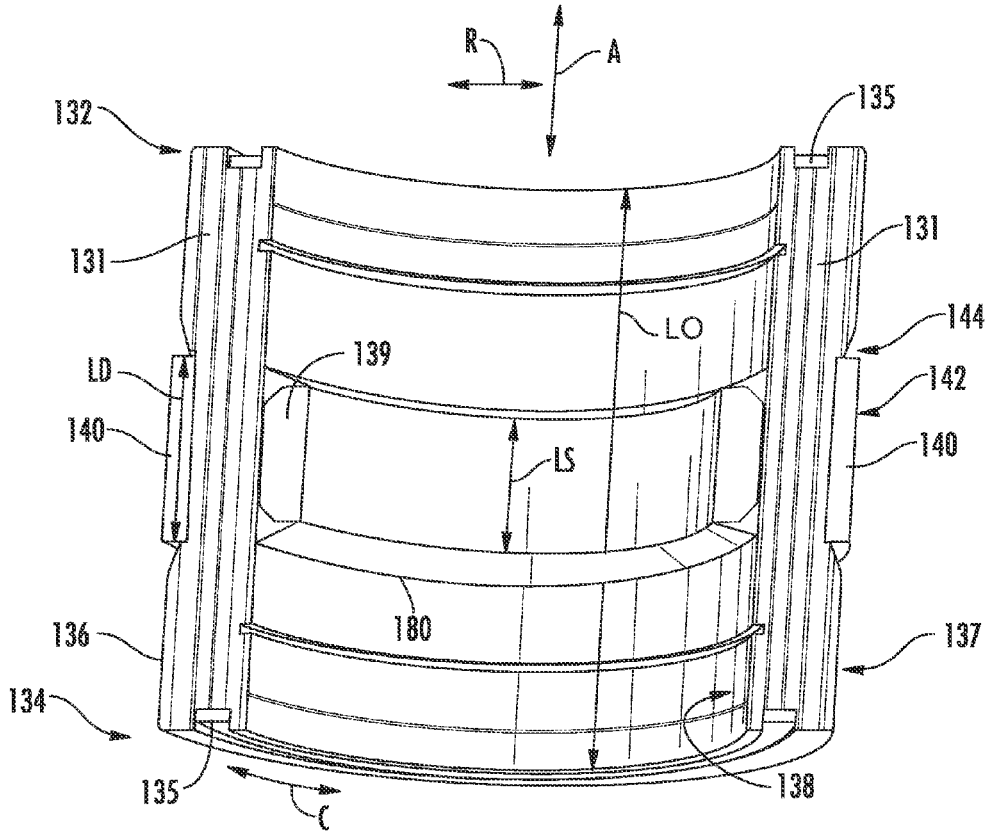
FIG. 13 provides a section view of the inner back iron assembly of FIG. 11.

FIG. 13 provides a section view of inner back iron assembly 130. As discussed above, sleeve 139 is positioned on or at inner surface 138 of outer cylinder 136. In particular, sleeve 139 is welded to outer cylinder 136 at inner surface 138 of outer cylinder 136. For example, sleeve 139 may be welded to laminations 131 of outer cylinder 136 at inner surface 138 of outer cylinder 136. Thus, a weld 180 may mount sleeve 139 to outer cylinder 136 at inner surface 138 of outer cylinder 136. Weld 180 can assist with stiffening or reinforcing outer cylinder 136 by coupling laminations 131 of outer cylinder 136 to sleeve 139.

Inner back iron assembly 130 may be constructed in any suitable manner. As an example, inner back iron assembly 130 may be constructed by forming laminations 131 into a cylindrical shape and securing laminations 131 together, e.g., with rings 135, in order to form outer cylinder 136 of inner back iron assembly 130. Sleeve 139 may then be inserted into outer cylinder 136, e.g., such that sleeve 139 is positioned on inner surface 138 of outer cylinder 136. Sleeve 139 may then be welded (e.g., TIG welded, MIG welded, resistance welded, etc.) to outer cylinder 136 such that weld 180 fixes or secures sleeve 139 to outer cylinder 136.

Machined spring 120 may then be inserted into outer cylinder 136 and sleeve 139. Middle portion 110 of machined spring 120 is then attached to sleeve, e.g., with an interference fit between machined spring 120 and sleeve 139. Driving magnet 140 may then be mounted to outer cylinder 136, e.g., at or adjacent outer surface 137 of outer cylinder 136. It should be understood that the steps described above may be performed in any suitable order to form inner back iron assembly 130 in alternative exemplary embodiments.

Turning back to FIG. 13, outer cylinder 136 has a length LO, e.g., along the axial direction A. Sleeve 139 also has a length LS, e.g., along the axial direction A, and driving magnet 140 has a length LD, e.g., along the axial direction A. The length LO of outer cylinder 136, the length LD of driving magnet 140 and the length LS of sleeve 139 may be any suitable lengths. For example, the length LO of outer cylinder 136 may be greater than the length LD of driving magnet 140, and the length LD of driving magnet 140 may be greater than the length LS of sleeve 139. Sleeve 139 may also be positioned concentrically within driving magnet 140.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A linear compressor, comprising:

a driving coil;

an inner back iron assembly positioned in the driving coil, the driving coil operable to move the inner back iron assembly along an axis during operation of the driving coil, the inner back iron assembly extending between a first end portion and a second end portion, the inner back iron assembly comprising an outer cylinder and a sleeve, the outer cylinder having an outer surface and an inner surface positioned opposite each other, the outer cylinder comprising a plurality of laminations distributed circumferentially about the sleeve, the sleeve mounted to the outer cylinder at the inner surface of the outer cylinder;

a magnet mounted to the inner back iron assembly at the outer surface of the inner back iron assembly such that the magnet faces the driving coil, the magnet positioned in a recess defined by the laminations of the outer cylinder such that the magnet is inset within the outer cylinder;

a machined spring comprising a first cylindrical portion positioned adjacent the first end portion of the inner back iron assembly, a second cylindrical portion positioned within and fixed to the inner back iron assembly, the sleeve extending between the inner surface of the outer cylinder and the second cylindrical portion in order to fix the sleeve to the outer cylinder, a first helical portion extending between and coupling the first and second cylindrical portions together, a third cylindrical portion positioned adjacent the second end portion of the inner back iron assembly, and a second helical portion extending between and coupling the second and third cylindrical portions together;

a piston head connected to the inner back iron assembly; and a cylinder assembly defining a chamber, wherein the piston head is slidably received within the chamber.

2. The linear compressor of claim 1, wherein the first, second and third cylindrical portions and the first and second helical portions of the machined spring are positioned coaxially relative to one another.

3. The linear compressor of claim 1, wherein the first, second and third cylindrical portions and the first and second helical portions of the machined spring are continuous with one another.

4. The linear compressor of claim 1, wherein the sleeve is welded to the laminations of the outer cylinder at the inner surface of the outer cylinder.

5. The linear compressor of claim 1, wherein the laminations of the plurality of laminations are secured to one another with rings at the first and second end portions of the inner back iron assembly.

6. The linear compressor of claim 1, wherein the laminations of the plurality of laminations comprise a ferromagnetic material.

7. The linear compressor of claim 1, wherein the first helical portion of the machined spring includes a first pair of helices that are separate from each other and the second helical portion of the machined spring includes a second pair of helices that are separate from each other, each helix of the first pair of helices extending between the first and second cylindrical portions, each helix of the second pair of helices extending between the second and third cylindrical portions.

8. The linear compressor of claim 7, wherein the first and second pairs of helices are oppositely wound.

9. The linear compressor of claim 1, wherein the outer cylinder, the sleeve and the magnet each define a length along the axial direction, the length of magnet being greater the length of the sleeve, the length of the outer cylinder being greater than the length of the magnet.

10. A linear compressor defining a radial direction, a circumferential direction and an axial direction, the linear compressor comprising:

a machined spring;

an inner back iron assembly extending about the machined spring along the circumferential direction, the inner back iron assembly comprising an outer cylinder and a sleeve, the outer cylinder having an outer surface and an inner surface spaced apart from each other along the radial direction, the outer cylinder comprising a plurality of laminations distributed along the circumferential direction about the sleeve, the sleeve positioned at the inner surface of the outer cylinder, the sleeve extending between the inner surface of the outer cylinder and a middle portion of the machined spring along the radial direction;

a driving coil extending about the inner iron assembly along the circumferential direction, the driving coil operable to move the inner back iron assembly along an axis during operation of the driving coil;

a magnet mounted to the inner back iron assembly such that the magnet is spaced apart from the driving coil by an air gap along the radial direction, the magnet positioned in a recess defined by the laminations of the outer cylinder such that the magnet is inset within the outer cylinder;

a piston head connected to the inner back iron assembly; and a cylinder assembly defining a chamber, wherein the piston head is slidably received within the chamber.

11. The linear compressor of claim 10, wherein the sleeve is welded to the laminations of the outer cylinder at the inner surface of the outer cylinder.

12. The linear compressor of claim 10, wherein the laminations of the plurality of laminations are secured to one another with rings at opposite sides of the inner back iron assembly.

13. The linear compressor of claim 10, wherein the machined spring includes a first helical portion and a second helical portion, the first helical portion of the machined spring having a first pair of helices that are separate from each other, the second helical portion of the machined spring having a second pair of helices that are separate from each other.

14. The linear compressor of claim 13, wherein the first and second pairs of helices are oppositely wound.

15. The linear compressor of claim 10, wherein the outer cylinder, the sleeve and the magnet each define a length along the axial direction, the length of magnet being greater the length of the sleeve, the length of the outer cylinder being greater than the length of the magnet.

16. A method for making an inner back iron assembly for a linear compressor comprising:

forming a plurality of laminations into a cylindrical shape;

securing the laminations of the plurality of laminations together in order to form an outer cylinder of the inner back iron assembly;

inserting a sleeve into the outer cylinder such that the sleeve is positioned on an inner surface of the outer cylinder;

welding the sleeve to the outer cylinder;

attaching a middle portion of a machined spring to the sleeve; and mounting at least one magnet onto an outer surface of the outer cylinder such that the at least one magnet is positioned in a recess defined by the laminations of the outer cylinder such that the magnet is inset within the outer cylinder.

17. The method of claim 16, wherein said step of attaching comprises attaching the middle portion of the machined spring to the sleeve with an interference fit between the machined spring and the sleeve.

18. The method of claim 16, wherein the outer cylinder, the sleeve and the at least one magnet each define a length along an axial direction, the length of magnet being greater the length of the sleeve, the length of the outer cylinder being greater than the length of the magnet.

19. The method of claim 16, wherein said step of securing comprises press-fitting a ring into the outer cylinder at each of a first end portion of the inner back iron assembly and a second end portion of the inner back iron assembly.

* * * * *